United States Patent [19]

Slodzian et al.

[11] Patent Number: 4,801,849

[45] Date of Patent: Jan. 31, 1989

[54] ION SOURCE OPERATING BY SURFACE IONIZATION IN PARTICULAR FOR PROVIDING AN ION PROBE

[75] Inventors: Georges Slodzian, Sceaux; Bernard Daigne, Chatenay Malabry; Francois Girard, Paris, all of France

[73] Assignees: Office National D Etudes et de Recherches, Chatillon; Aerospatiales and Universite de Paris-Sud, Orsay, both of France

[21] Appl. No.: 119,241

[22] Filed: Nov. 6, 1987

Related U.S. Application Data

[63] Continuation of Ser. No. 730,172, May 3, 1985, abandoned.

[30] Foreign Application Priority Data

May 16, 1984 [FR] France ..... 84 07606

[51] Int. Cl.[4] ..... H01J 27/00

[52] U.S. Cl. ..... 315/111.81; 313/362.1; 250/423 R; 250/425

[58] Field of Search ..... 315/111.81; 313/361.1, 313/362.1; 250/423 R, 425, 427

[56] References Cited

U.S. PATENT DOCUMENTS

| | | | |
|---|---|---|---|
| 2,486,452 | 11/1949 | Washburn et al. | 250/427 |
| 3,283,193 | 11/1966 | Ellison | 313/230 |
| 3,336,475 | 8/1967 | Kilpatrick | 250/423 R |
| 3,852,037 | 12/1974 | Kolb et al. | 422/54 |
| 3,864,575 | 2/1975 | Hashmi et al. | 250/425 |
| 4,453,078 | 6/1984 | Shimizu | 315/111.81 |

FOREIGN PATENT DOCUMENTS

Ad.65999 5/1954 France .

OTHER PUBLICATIONS

Nuclear Instr. & Methods in Physic Research, vol. 185, Jun. 1981, Whealton, J. H., "Negative Ion Sources", pp 25-27.

Rev. Sci. Instrum., vol. 48, No. 2, Feb. 1977, Kashihira, N., "Source for Negative Halogen Ions", pp. 171-172.

Applied Physics Letters, vol. 28, No. 5, Mar. 1976, Rachidi, I., "Surface Ionization Negative Ion Source", pp. 292-294.

*Primary Examiner*—Leo H. Boudreau
*Assistant Examiner*—Theodore Salindong
*Attorney, Agent, or Firm*—Staas & Halsey

[57] ABSTRACT

An ion source is described, including a source of neutral particles which arrive at an ionization support positioned inside a chamber which is closed by a cap and which includes lateral walls. The cap includes an outlet orifice opposite which a plate defines a main ionization active surface. An electric field is applied between said device and by an electrode place downstream from the orifice in the direction of ion emission and fitted with a corresponding opening. Overall, the ionization support defines, by virtue of its active surface, and by virtue of holes surrounding said central active surface, a baffle assembly which prevents neutral atoms from passing directly to the outlet orifice, and which contributes to a high degree of ionization.

13 Claims, 3 Drawing Sheets

FIG. 4
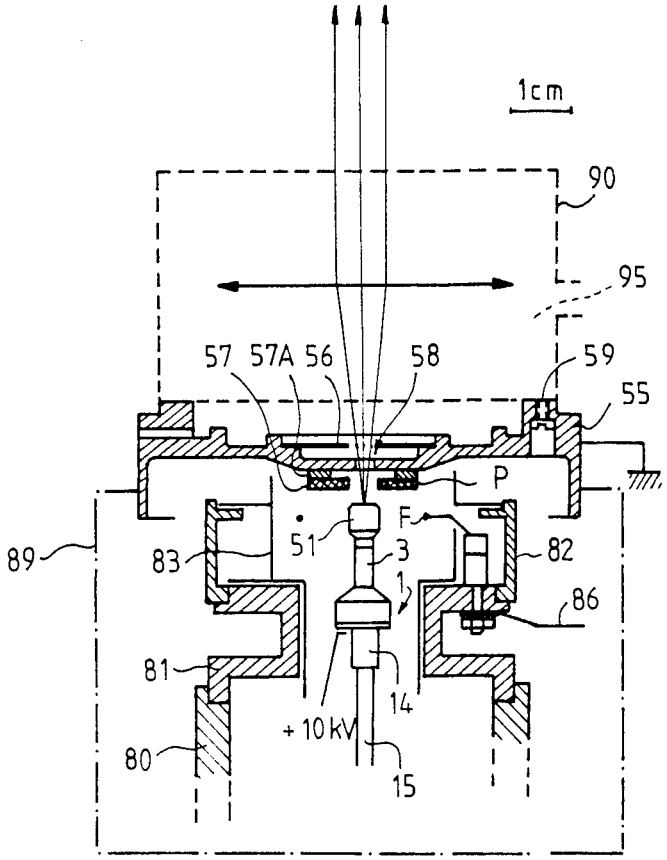
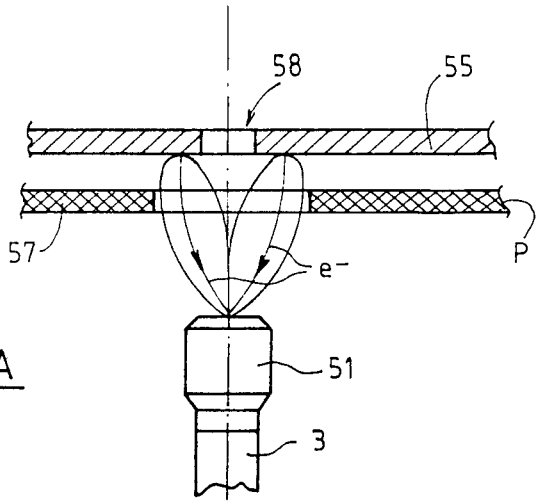
FIG. 4A

ION SOURCE OPERATING BY SURFACE IONIZATION IN PARTICULAR FOR PROVIDING AN ION PROBE

This is a continuation of co-pending application Ser. No. 730,172 filed on May 3, 1985, abandoned.

The invention relates to ion sources operating by surface ionization.

BACKGROUND OF THE INVENTION

Ion sources of this type are already known which comprise, in vacuo, a source of neutral particles of the same nature as the ions to be produced, an ionization support which possesses at least one active surface suitable for adsorbing the neutral particles, and then desorbing them as ions, means for bringing the neutral particles to the ionization support which then transforms them into ions by adsorption/desorption, and means for directing the major portion of the ions produced in this way into a beam which is emitted in a predetermined direction.

It has been known for a long time that an atom may be desorbed from a hot surface as a positive or negative ion. The main parameters governing this phenomenon are firstly the temperature of the ionization support and the work function, i.e. the work required to extract an electron, and secondly the ionizing propensity of the desorbing element. This propensity is expressed by the ionization potential or by the electron affinity, depending on whether the ionization is positive or negative.

The degree of ionization obtained during such desorption is governed by the Saha-Langmuir equation. This equation shows that the degree of ionization is an exponential function of the difference between the work required to leave the heated support and either the ionization potential for positive ions or the electron affinity for positive ions.

In order to produce given ions, it is possible to obtain an ionization probability close to unity by choosing a suitable material for the ionization support. Support temperature then has only a small effect on ionization probability. However, temperature is the key factor governing the desorption process. In particular, temperature affects the length of time which an adsorbed atom remains on the surface of the support.

Thus, the degree to which a hot surface receiving, for example, a jet of alkali atoms such as potassium, rubidium, or cesium, is covered in adsorbed atoms per unit area under steady state conditions without adsorbed ions accumulating, depends on the incident flux of neutral atoms and on the temperature of the support. However, the presence of the adsorbed atoms modifies the work functions and can thus have an effect on ionization probability, and in particular may considerably reduce it. It thus appears that ion sources operate in a complex manner.

One of the main qualities of an ion source is its brightness which may be defined by the expression:

$$dI = B.ds.d\Omega.dE$$

where dI is the intensity of the beam emitted by a surface element ds in a solid angle $d\Omega$ defined about a direction which is defined by angles $\theta$ and $\phi$, and in an energy band lying between E and E+dE. The brightness B is a function of $\theta$, $\phi$ and E.

As a simplified example, consider a plane emitting surface which is parallel to a plane electrode having a round hole therethrough. A positive or negative voltage V is established between the emitting surface and the electrode which is placed at ground potential. Assume that B is independent of the azimuth angle $\phi$ and that it varies as a function of $\theta$, the angle of the emission direction to the normal, in accordance with Lambert's cosine law. The brightness B can then be written:

$$B = V/\pi E_o.dJ_o/dE_o$$

where $E_0$ is the initial energy of a particle leaving the surface nd $J_0$ is the current density (current per unit area) of the particles at the emitting surface. In may be observed in this example that thermal ion sources provide a low value for the initial energy $E_0$ of an ion leaving the surface. It may also be observed that the arrival function which defines the incident flux of neutral particles has a major effect since this function controls the current density $J_0$.

Ion sources are already known in which the ionizing member is a pellet of sintered tungsten. An alkali vapor passes into the interstices which remain between the tungsten grains. The pellet is raised to a temperature of about 1200° C., and it is placed in an electric field for accelerating the ions which emerge from between the grains. The source of neutral particles is a pool of liquid cesium whose temperature is adjusted to obtain a cesium vapor pressure which is high enough to cause said vapor to diffuse through the pores of the sintered tungsten pellet. This first known source of ions thus has the peculiarity of the atoms to be ionized passing through the ionization support.

This type of ion source is capable of delivering high currents, so long as a large emitting surface area is used.

This is a considerable handicap when an ion sonde or probe is to be produced, i.e. a source of ions which produces a narrow beam. A priori it is difficult to make such an emitting surface small, and it is therefore necessary to work with a relatively large emitting surface with a major portion of the ions produced therefrom being subsequently eliminated by diaphragms.

Ion sources are also known which use a hot filament. They are assembled in substantially the same manner as an electron gun: a hair-pin shaped filament is placed in the middle of a circular orifice through an electrode which acts both as a screen grid and as a control grid. The filament and the control grid are both raised to a high positive voltage and are disposed opposite an electrode at ground potential having a circular hole therethrough (equivalent to the anode of an electron gun). The space between the filament and this "anode" is filled with cesium vapor from an adjoining oven. Cesium atoms which are ionized on the tip of the filament are accelerated by the electric field and leave via the hole through the "anode" and they appear to come from a virtual source of small size. This known assembly provides a sufficiently small source to make an ion probe. However, it suffers from two major drawbacks: the first is that above 5 kilovolts (kV), flash-overs become frequent for reasons which are difficult to master such as the insulators becoming coated in metal and parasitic emission of electrons; and the second is that the cesium vapor escapes through the outlet hole and condenses in other parts of the installation.

Ion sources are also known in which the ionization support is in the form of a baffle or chicane, thereby reducing the number of neutral particles which pass into the emitted ion beam.

Such equipment is described in French certificate of addition No. 65 999 which relates to a discharge tube. The baffle is very simple and works on condition that the neutral atoms propagate in straight lines. However, the ion source in this prior document has low brightness, is subject to high energy dispersion, and is rather large. Further, it appears to suffer from lack of stability and to tolerate the vapor filling the inside of the discharge tube, since this is acceptable in discharge tubes.

Up to a point, U.S. Pat. No. 3,283,193 may also be considered as describing a baffle, in the rather specialized context of catalytically producing nascent hydrogen. Electron bombardment ionizes a portion of the hydrogen atoms before they have the time to recombine into molecules. Here again, it is clear that the ion source made in this way has low brightness, is large, and is dispersed in energy. It is also fairly unstable, and vapor is liberated outside the ionizer itself, since few hydrogen atoms are effectively ionized.

Under such conditions, the present invention provides a novel ion source having manifest advantages over prior art ion sources, and in particular:

a very small emitting surface area, which may be very bright when required;

no direct flux of neutral atoms or particles in the remainder of the installation;

an accelerating voltage greater than 10 kV without causing flash-overs;

it uses a solid source of neutral particles operating at low pressure and thus avoiding the use of liquid metal;

a stable beam of ions with low energy dispersion; and an ion beam of well-determined geometry, thereby avoiding electrode erosion by cathode sputtering.

SUMMARY OF THE INVENTION

The present invention provides a source of ions operating by surface ionization, the source being of the type which comprises, in vacuo:

a source of neutral particles of the same nature as the ions to be produced;

means for defining together with said source a duct which is closed except for an end orifice situated opposite said source;

an ionization support having an active surface facing said orifice and suitable for adsorbing neutral particles, and then desorbing them in the form of ions, said ionization support constituting a baffle to oppose the passage of neutral particles into the emitted ion beam; and means for focusing the ions produced in this manner through the orifice into a beam which is emitted in a chosen direction;

wherein the ionization support is constituted by a stack of thin conductive parts forming an inside cylindrical passage which is coaxial with the outlet orifice, and which is of smaller right cross-section than the cross-section of said closed duct, and wherein the baffle is defined by the fact that one of the thin parts is a plate extending across the passage and having a central portion in said passage defining said active surface opposite the outlet orifice, which central portion is surrounded by peripheral holes passing through the plate, thereby providing a near-perfect baffle preventing the direct passage of neutral particles into the emitted beam without previously encountering the active surface of the ionization support.

Advantageously, the ionization support is housed in a conductive cap mounted at the end of said duct, which duct is completely closed by said cap except for the outlet orifice thereof. The dimensions of the duct are adapted to retain the baffle effect provided by the ionizing support.

Most advantageously, the focusing means comprise an external focusing electrode having a hole therethrough and arranged to establish an electric field between the active surface and the outlet orifice suitable for accelerating the ions to constitute the emission beam.

Preferably, the potential difference between the active surface and the external electrode is at least 10 kV, with the outlet orifice being a few tenths of a millimeter across and being outwardly flared.

The ion source preferably includes means for heating the ionization support, and preferably to a temperature in the range 1000° C. to 1500° C.

Under such conditions, the source of neutral particles may comprise a solid compound suitable for delivering the particles by pyrolysis, and preferably without giving off gas.

The active surface of the ionization support facing the outlet orifice may be convexly curved.

As is explained below, this ion source is particularly suitable for operating with positively ionized alkali atoms and also with negatively ionized halogen atoms.

Suitable arrangements of the active ionization surface make it possible to obtain a beam which is as rich in ions at its periphery as at its center, or otherwise to obtain a beam in which the ions are for the most part concentrated on the emission axis.

BRIEF DESCRIPTION OF THE DRAWINGS

Embodiments of the invention are described by way of example with reference to the accompanying drawings, in which:

FIGS. 4 and 4A show another alternate embodiment of an ion source in accordance with the invention.

DETAILED DESCRIPTION OF THE PREFERRED EMBODIMENTS

An essential feature of an ion source in accordance with the invention is its geometry. As a consequence, the accompanying drawings should be considered as constituting an integral part of the present description, serving, where appropriate, to ensure that the description is complete and sufficient, and also contributing the definition of the invention.

Figure 1:
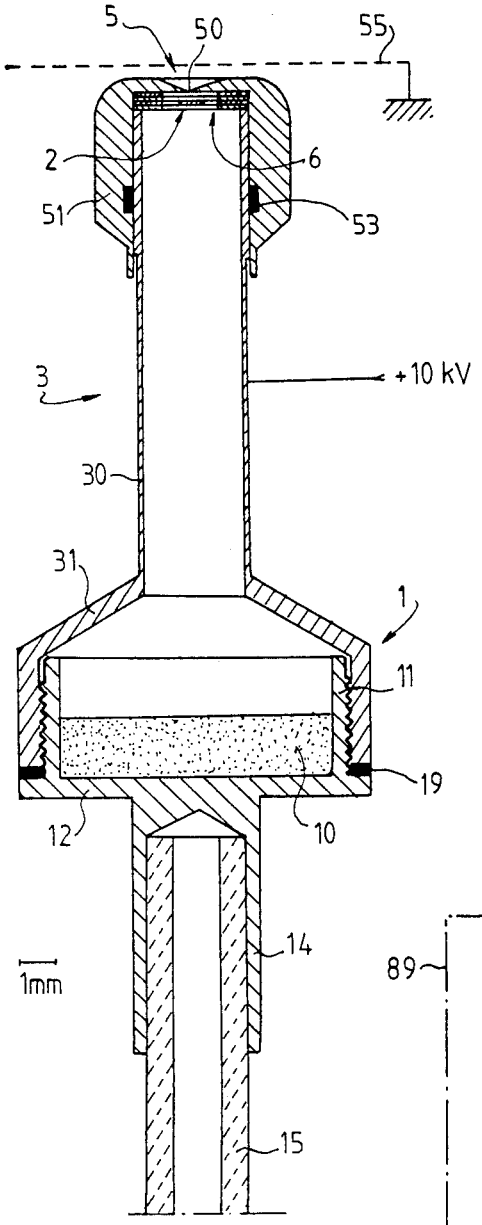
FIG. 1 is a vertical section through the major portion of an ion source in accordance with the invention.

The source of neutral particles is designated 1. It comprises a receptacle constituted by a cylindrical side wall 11 and a bottom 12 which is fixed to a downwardly directed sleeve 14 suitable for engaging an alumina support 15. Apart from the alumina support 15, all the parts of the ion source shown in FIGS. 1 and 2 are made of metal.

The receptacle 1 is covered by a bell 31 which leads to a tubular metal duct 30 constituting means 3 for bringing neutral particles to the ionization support 2.

The bell 31 is screwed to the wall 11 and a copper sealing ring 19 is disposed therebetween.

In the receptacle 1, there is a solid compound 10 suitable for producing vapor by pyrolysis. The vapor may or may not be ionized and the solid compound may be in compact form, as shown, or it may be in the form of discrete particles.

We begin by considering positive alkali ions such as ions of cesium, rubidium or potassium. These ions are of interest since their ionization potential is smaller than the work function of most metals. As mentioned above, the probability of positive ionization by desorption is close to unity under such circumstances.

The corresponding neutral atoms, together with ions, if any, may be produced by pyrolysis of a compound such as an alumino-silicate, an iodide, or a carbonate, for example. Alumino-silicates are particularly advantageous in that they leave a solid residue only and do not give off any gases. The top end of the tube 30 is provided with a cap 51 which completely closes it apart from an outlet orifice 50 which is upwardly flared such that it has a cross-section in the form of a flattened V. The periphery of the cap extends axially over a substantial length of the tube 30. A groove machined in the inside wall of the molybdenum cap 51 houses a nickel sealing ring 53 which is welded by electron bombardment.

Figure 3:
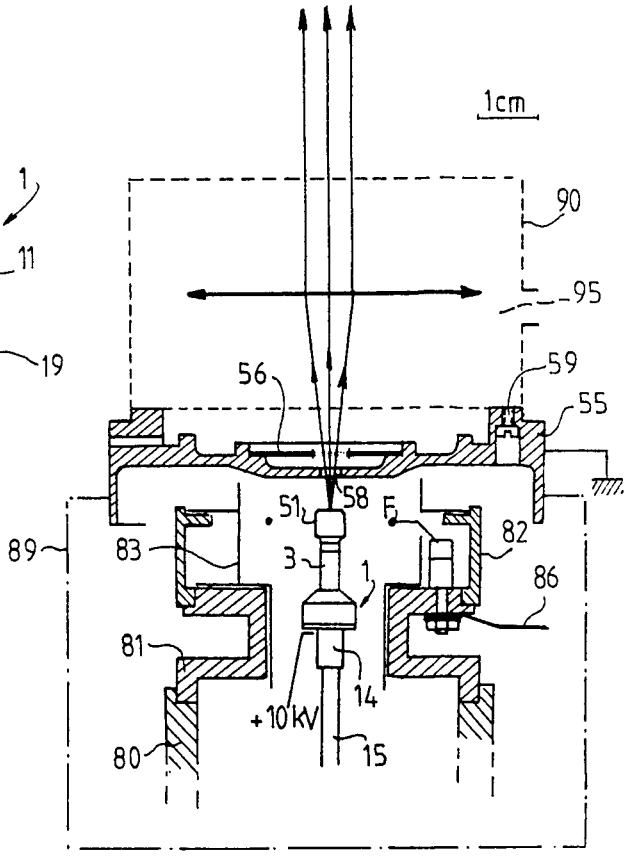
FIG. 3 is a vertical section through ion source equipment including the FIG. 1 source.

The ion source assembly is raised to a potential of 10 kV, for example, which may be applied to the tube 30, or to the receptacle 1 (FIG. 3). An electrode 55 at ground potential is placed in front of the opening 50.

The structure of the electrode 55 is described below with reference to FIG. 3.

Together, the cap 51, the orifice 50 and the electrode 55 define means 5 for focusing the ions produced in the form of a beam which is emitted in a chosen direction.

These ions are produced by means of the ionization support 2, and inserted between the cap 50 and the top end of the tube 30.

The ionization support will now be described with reference to FIG. 2A. It comprises a first annular washer 61 bearing against the tube 30, a plate 62 having four holes 65 to 68 therethrough as in FIG. 2B, a second washer 63, and an optional last washer 64, with the assembly being pressed against the lower face 25 of the cap 51.

The inventors have observed that by varying the distance between the plate 62 and the inside face 25 of the cap, and by varying the diameter of the orifice 50, of the holes 65 to 68, and of the circle 60 on which the centers of said holes are located, it is possible to achieve a near-perfect baffle 6 such that alkali atoms from the receptacle 1 can only leave the ion source after encountering the surface 20 of the plate 62 where it faces the outlet orifice 50. The very great majority of the neutral particles produced by the receptacle 1 are thus prevented from leaving via the outlet orifice 50.

As mentioned above, the phenomena involved are complex and up to now they have not been fully explained. It appears that the following characteristics are important in obtaining an effective baffle:

there should be no (or very little) chance of a neutral atom passing directly from the duct 30 into the opening 50;

the baffle 6 is laterally delimited by the circular inside walls 21 to 24 and axially delimited by the inside radial lower face 25 of the cap; a neutral atom should necessarily collide with one or more of these walls prior to coming into contact with the active surface 20 from which the major part of ion emission through the orifice 50 takes place; and the distance between the surface 20 and face 25 should be as small as possible.

Another factor is the mean free path of the neutral atoms in the vapor being used, e.g. cesium vapor. The relationship between this mean free path which is generally fairly long, and the dimensions of the duct 30 and of the baffle components has not yet been properly established.

It should also be observed that the walls 21 to 24 and also the lower face 25 are made of metal, like the active surface 20, and are therefore also capable of generating ions by adsorption/desorption. Ions created in this manner may be adsorbed and then desorbed on the main active surface 20, and a few of them may leave directly via the orifice 50. The half-angle at the apex of the cone of the flared orifice 50 is about 30°, thereby enabling some electron trajectories to be initially at a considerable angle to the main emission direction D shown in FIG. 2A. The applied electric field which accelerates the ions in the direction D bends these trajectories so that they come back to the axis.

Further, neutral particles could be prevented from passing directly from the tube 30 to the orifice 50 by removing the washer 64 which is 0.1 mm thick as are the other stacked items 61 to 63. Removing the washer 64 further reduces the distance between the surfaces 20 and 25.

In the embodiment described, the baffle is essentially established by the fact that the plate 62 has four off-center holes 65 to 68 which are regularly distributed around its central portion. Naturally, this disposition is not limiting. There could be a larger number of holes, and they could be disposed irregularly provided they are suitably off center. Alternatively, arcuate openings could be made through the plate 62 leaving just sufficient material to support the central portion 20.

In most applications, it is necessasry for the end of the tube 30, the cap 51, and the plate 62 (and likewise the washers 61, 63 and 64) to be heated to a temperature in the range 1000° C. to 1500° C. The receptacle 1 must be sufficiently heated for pyrolysis of the compound stored therein. These two heating actions may be independent.

In the embodiment shown in FIG. 3, heating is provided by electron bombardment from a filament F which is supplied with an adjustable electric current to enable the desired temperature to be obtained. Independent heating for the receptacle is not essential since the section and the length of the tube 30 may be provided in such a manner that heat losses due to the ionizing support being heated are sufficient to raise the receptacle 1 together with the compound therein (cesium alumino-silicate) to an adequate temperature.

With further reference to FIG. 3, it can be seen that a metal support 80 has an alumina spacer 81 mounted thereon which supports a metal electrode 82 that is protected behind a heat screen 83.

The items 14, 15, 1, 3 and 51 described with reference to FIG. 1 and constituting the ion source per se can be seen in the middle. The filament F is located around the cap 51, and it is powered from an electrical connection 86 passing through the spacer 81.

The electrode 55 is placed above the ion source, and in this case is in the form of a circular annulus having a central hole 58 through which the ions pass. A short distance downstream from the hole 58, the electrode 55 supports a tantalum heat screen 56 having a central hole. Further downstream, a support member 59 for the grounded electrode 55 supports a lens shown diagrammatically by dashed lines at 90, which lens receives a positive high voltage at 95. Finally, the underside of the electrode 55 is connected to a chamber shown diagrammatically at 89 which serves to isolate the ion source from its surroundings and enables a partial vacuum to be established therein, as is desirable for proper operation thereof.

The particular lens 90 is selected as a function of the intended use for the ion source. For an ion probe, the lens 90 serves to create a real image of the virtual point source as constituted by the ion source in accordance with the invention.

Experiments have been performed that show that the virtual source obtained using such an ion source is about 50 microns in diameter for components of the size indicated in the drawings. This configuration has the advantages mentioned above over prior art configurations.

Figure 2A:
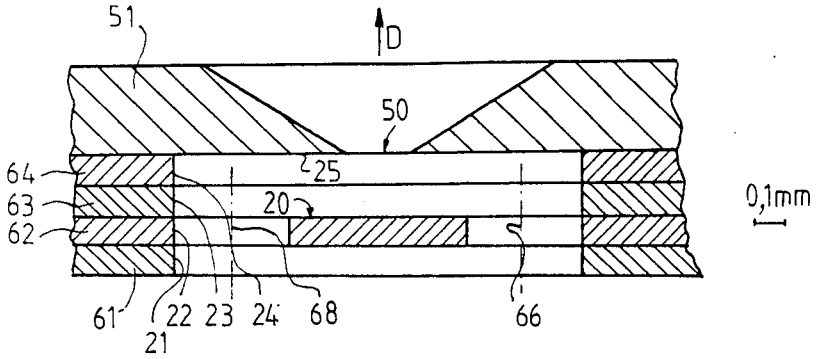
FIG. 2A shows details of the top of FIG. 1.
Figure 2B:
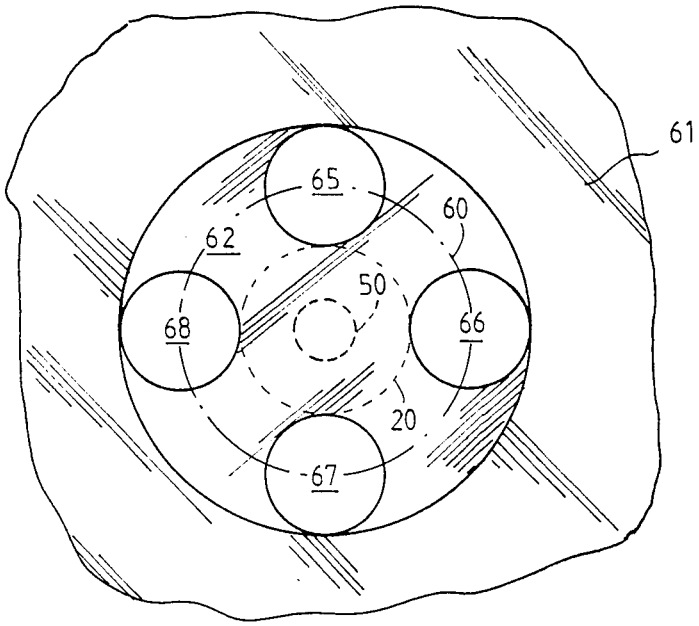
FIG. 2B is a bottom view of the FIG. 2A details.

The core of the probe is constituted by the cap 51, the baffle which should be as thin as possible (i.e. as small as possible a distance between the surfaces 20 and 25 of FIG. 2A), and the extraction electrode 55 whose function is to establish as strong an electric field as possible at the surface 20 of the source of ions in order to extract the ions therefrom. A strong electric field enables a bright source to be obtained without it being necessary to increase the diameter of the orifice 50.

When operating with a high extractor field, it has been observed that the ions of the emitted beam may strike the wall of the focusing electrode 55 around the hole 50 therethrough. The electrode 55 is made of a material, such as tantalum, which emits few negative ions when bombarded by the positive ions of the beam. However, this positive ion bombardment creates electrons which return to bombard the cap 51 at +10 kV.

This parasitic phenomenon further heats the cap (and the rest of the ion source). As a result the heating electricity supply is reduced, and it may become impossible to control the temperature of the ion source.

An alternate embodiment illustrated in FIGS. 4 and 4A takes advantage of the above-mentioned parasitic effect.

An insulating insert 57A is disposed beneath the electrode 55 around its central hole 58 and supports an annular electrode 57 whose free inside edge is coaxial with the central hole 58. By biasing this additional electrode 57 to a potential P=−320 V, or thereabouts, secondary emission is stopped, i.e. secondary electrons and any secondary negative ions due to the focusing electrode 55 being bombarded by positive primary ions are stopped.

Better still, by applying a positive bias potential of P=+320 V or thereabouts to the additional electrode 57, the secondary electrons (and any secondary ions) are focused on the active surface 20 (FIG. 2A) of the ion source 51, the focusing action being as shown in FIG. 4A.

The operation of the ion source is then set in motion by heating the cap 51 by means of the filament F as before. Then the bias potential of the additional electrode 57 is adjusted to focus the secondary electrons on the active surface 20. Heating by means of the filament F can then be stopped, or at least reduced to compensate for heat loss via the outside walls of the ionizing assembly (i.e. via components 1 to 5).

Other alternate embodiments of the invention will now be described.

In the above description, the active surface of the ion source has been essentially constituted by the surface 20 shown in FIG. 2A. However, any surface of the same metal raised to a sufficient temperature may, to some extent, also act as an active surface, e.g. the inside lower face 25 of the cap, and the side walls 21 to 24 as already mentioned. The ions produced by the side walls may subsequently encounter the active surface 20 and leave it while still in the ionic state and be subject to the acceleration causing them to leave via the outlet orifice 50 and then via the hole 58 (FIG. 3).

However, the ions emitted by the face 25 from a margin close to the hole 50 encounter the electric field which may then impose a curved trajectory thereon causing them to leave via the orifice 50 and hole 58 without further impact.

This does not alter the small size of the virtual source obtained in accordance with the invention. Indeed, it appears merely to increase the intensity delivered therefrom.

However, the distribution of the ions emitted by the beam is no longer substantially Gaussian and centered on the main direction D but, on the contrary, the distribution is rather broad, or in other words it is reinforced around the periphery of the beam.

When used as an ion probe, it is necessary to reduce the size of the virtual source by an optical reducing system constituted by one or more electrostatic lenses 90. Because of optical invariants, any reduction in the size of the beam by such means produces an increase in the aperture angle, and consequently increases aperture aberrations, thereby going against the object of the exercise which is to produce a probe of small size. This effect makes it necessary to reduce the aperture angle by interposing suitably disposed diaphragms. Under such conditions, since the ions from the above-mentioned circular margin are not present at small aperture angles, they are of no use in creating an ion probe.

In this application (see FIG. 2C) it is possible to place a thin disk of lanthanum hexaboride against the inside face 25 of the cap. This disk is referenced 64A and has a central hole of substantially the same size as the orifice 50. The disk 64A may be replaced by a deposit of lanthanum hexaboride made by evaporation in vacuo. Since the thickness is reduced, the electric extraction field is increased.

Unlike metals, lanthanum hexaboride has a work function which is smaller than the ionization energy of the cesium (for example). As a result cesium atoms striking the lanthanum hexaboride disk leave it in the form of neutral atoms and thus strike the active surface 20A which is the only ionizing surface.

It might have been feared that by acting in this manner the ion beam due to the contribution previously available from the margin of the parts 25 around the orifice 50 would have been lost. Unexpectedly it has been observed that the contrary is true. The conditions under which alkali atoms are supplied to the active surface 20A are modified in such a manner as to improve the brightness of the source. We do not have a complete explanation for this phenomenon, but it may be due to other effects, such as electron emission from lanthanum hexaboride and the difference in contact potential between the lanthanum hexaboride and the plate creating an electric field between the inside face of the plate 64A and the active surface 20A. Space charge effects may also be occurring, and these would be different in the FIG. 2A configuration and the FIG. 2C configuration.

Further, it turns out that the point-like nature of the source obtained may be further improved by bombarding the active surface 20A of the plate 62 as much as possible. In other words, the surface 20A (or the surface 20 of FIG. 2A) should be made highly convex where it faces the orifice 50.

The beam of ions obtained is then particularly suitable for constituting an ion probe.

In other applications, it may be desirable to produce a conical beam with a hollow center. It is then appropriate to replace the plate 62, at least at its surface 20 by a plate of lanthanum hexaboride and to restrict the production of ions solely to the circular margin on the surface 25 around the orifice 50.

The above description is solely concerned with the production of positive ions. An ion source in accordance with the invention can also be used to produce negative ions. Naturally this requires the voltage between the ionizer and the electrode 55 to be inverted to −10 kV. In this case, the additional electrode 57 is biased to +320 V and serves to stop positive ions.

It can immediately be seen that the last-described embodiment has a metal surface 25 and a surface 20 made of lanthanum hexaboride. For negative ions, relative to elements whose electron affinity is high, this would produce a beam of ions leaving the surface 20. This beam of ions comes from a very small point source and is suitable for use as an ion probe. For example, iodine crystals may be placed in the receptacle, thereby producing iodine vapor when lightly heated. Iodine atoms do not ionize on metal, but they do ionize on lanthanum hexaboride.

Figure 2C:
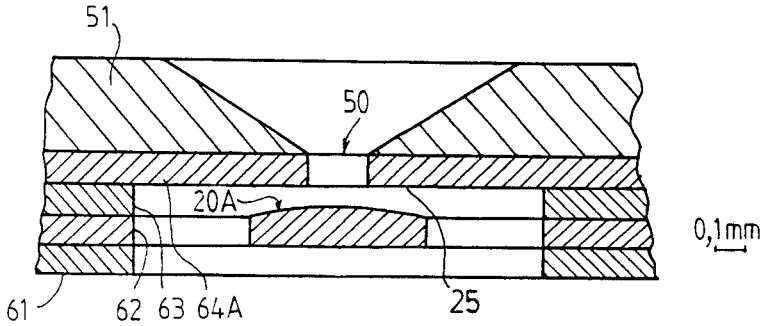
FIG. 2C is view similar to FIG. 2A, but shows an alternate embodiment of the invention.

Conversely, if it is desired to produce a conical beam of iodine ions which is hollow at the center, a FIG. 2C type of configuration is used in which the surface 20A no longer needs to be bombarded.

Finally, if it is desired to produce a very intense beam having ions both in the middle and in its periphery, the FIG. 2C assembly may still be used, but lanthanum hexaboride may be used not only for the plate 64A, but also for the active surface 20A, which may then be bombarded as before.

More generally, negative ions may be created using halogens, i.e. not only from iodine but also from chlorine, for example. It is also possible to produce negative ions from alkali atoms, although this appears to be of limited interest.

As a general rule, the ionization probability for positive ions is high when the material of the active surface possesses a work function which is greater than the ionization potential of said ions.

For negative ions, it is desirable for the active surface to have a work function which is less than the electron affinity of said ions.

In the above, great importance has been attached to ionization probability or to electron affinity. This is desirable when a very bright ion source is to be constructed as a kind of ion gun.

A rather different application consists in using the ion source at the inlet to a mass spectrometer for analyzing an unknown material. This material is placed in the receptacle 1, is heated and gives off atoms (which may be neutral or ionized) representative of the nature of the said material. These ions may readily be transformed into a beam using a source in accordance with the present invention. In such an application the brightness of the source is much less important. However, the other advantages remain just as important, i.e.:

high vapor pressure is not required from the source of neutral particles;

the ion-emitting surface area is small and the beam geometry is completely under control;

all neutral atoms must encounter the active ionizing surface before leaving the source; and high accelerating voltages may be used.

It may be observed that the geometry of the orifice 50 need not be circular. Its geometry may depend on the shape of the ion beam required for downstream work.

Finally, it may be observed that the ion source has been described for use in a vertical position. The relative disposition of the parts may be retained for use in a sloping or in a horizontal position, but the source of neutral atoms 1 should be modified accordingly so as to continue containing the solid compound 10.

We claim:

1. A small, high brightness, ion source comprising, in vacuo:

(a) source means for generating neutral particles by pyrolisis of a solid compound, said neutral particles having a nature similar to the ions to be produced;

(b) means for defining, together with said source, an elongated duct having a first end situated opposite said source, said first end including a small outlet orifice which is outwardly flared and a few tenths of a millimeter across;

(c) ionization means including a stack of thin conductive parts housed adjacent to each other in the first end of the duct, all but one of said thin conductive parts having a central hole so as to form an internal cylindrical pasage coaxial with the outlet orifice having a smaller cross-section than said duct, said one of said thin conductive parts, being a plate consisting of a central solid portion surrounded and incorporating peripheral holes therewith, said central solid portion being interposed in said internal cylindrical passage, and a side of said central solid portion facing the outlet orifice being an active surface adapted for adsorbing neutral particles and then desorbing them as ions;

(d) means for heating said ionization means;

(e) an external electrode adjacent to said first end of the duct having a central hole formed therein in alignment with said outlet orifice; and (f) focusing means for establishing an electrical field between said active surface and said external electrode and for focusing said ions into a beam passing through said outlet orifice.

2. An ion source as claimed in claim 1, wherein said active surface is convexly curved, facing the outlet orifice.

3. An ion source according to claim 1, wherein the ions are selected from the group comprising cesium, rubidium and potassium, and wherein the active surface is metal.

4. An ion source according to claim 3, wherein the cap includes an inside face having a thin disk of lanthanum hexaboride thereon with a central hole passing therethrough corresponding to the outlet orifice.

5. An ion source according to claim 1, wherein the ions are negative, the material making up the active surface possesses a work function which is less than an electron affinity of the ions, and the ions are selected from the group comprising iodine and chlorine.

6. An ion source according to claim 1, wherein the focusing means is provided on an upstream side with an additional electrode suitable for controlling return of secondary particles towards the ionization means, said secondary particles being generated by electron bombardment of the focusing means.

7. An ion source according to claim 6, wherein the ions are positive and the additional electrode is biased to stop the beam of secondary particles.

8. An ion source according to claim 6, wherein the ions are positive and the additional electrode is biased to focus the beam of secondary particles on the active surface of the ionization means through the outlet orifice of the cap, thereby providing at least a portion of the heating required by the ion source.

9. An ion source according to claim 7 or 8, wherein the focusing electrode is made of tantalum.

10. An ion source according to claim 1, further comprising: an optical reduction system downstream from the outlet orifice and the focusing means enabling said ion source to be used as an ion probe of very small size and very high brightness.

11. An ion source operating by surface ionization, comprising, in vacuo:

(a) a source of neutral particles of a nature similar to the ions to be produced;

(b) means for defining, together with said source, a duct which is closed at a first end except for an outlet orifice formed opposite said source;

(c) an ionization support having an active surface facing said outlet orifice, being suitable for adsorbing neutral particles and then desorbing them in the form of ions, including a baffle to oppose passage of neutral particles into an emitted ion beam, and being housed at the first end of the duct, said duct being completely closed apart from the outlet orifice, wherein the ionization support includes a stack of thin conductive parts adjacent to each other in the first end of the duct forming an inside cylindrical passage which is coaxial with the outlet orifice, and which is of smaller cross-section than the cross-section of the duct, and wherein the baffle is defined by one of the thin parts being a plate extending across the passage consisting of a central, solid portion in said passage defining said active surface opposite the outlet orifice, which central portion is surrounded by and incorporates peripheral holes therewith passing through the plate and said central solid portion being interposed in said inside cylindrical passage, thereby providing a baffle capable of preventing the direct passage of neutral particles into the emitted beam without previously encountering the active surface of the ionization support; and (d) means for focusing the produced ions through the outlet orifice into a beam which is emitted in a chosen direction, the focusing means including an external focusing electrode having a hole formed therethrough and arranged to establish an electric field between the active surface and the outlet orifice suitable for accelerating ions to constitute the emitted beam, the focusing electrode being provided on an upstream side adjacent said first end of the duct with an additional electrode suitable for controlling return of secondary particles towards the ionization support, said secondary particles being generated by electron bombardment of the focusing electrode, wherein the ions are positive and the additional electrode is biased to stop the secondary particles.

12. An ion source operating by surface ionization, comprising, in vacuo:

(a) a source of neutral particles of a nature similar to the ions to be produced;

(b) means for defining, together with said source, a duct which is closed at a first end, except for an outlet orifice formed opposite said source;

(c) an ionization support having an active surface facing said outlet orifice, being suitable for absorbing neutral particles and then desorbing them in the form of ions, including a baffle to oppose passage of neutral particles into an emitted ion beam, and being housed inside the first end of the duct, said duct being completely closed apart from the outlet orifice, wherein the ionization support includes a stack of thin conductive parts adjacent to each other in the first end of the duct forming an inside cylindrical passage which is coaxial with the outlet orifice, and which is of smaller cross-section than a cross-section of the duct, wherein the baffle is defined by one of the thin parts being a plate extending across the passage consisting of a central solid portion in said passage defining said active surface opposite the outlet orifice, which central solid portion is surrounded by and incorporates peripheral holes therewith passing through the plate and said central solid portion being interposed in said inside cylindrical passage, thereby providing a baffle capable of preventing the direct passage of neutral particles into the emitted beam without previously encountering the active surface of the ionization support; and (d) means for focusing ions through the outlet orifice into a beam which is emitted in a chosen direction, the focusing means including an external focusing electrode having a hole formed therethrough and arranged to establish an electric field between the active surface and the outlet orifice suitable for accelerating ions to constitute the emitted beam, the focusing electrode being provided on an upstream side adjacent said first end of the duct with an additional electrode suitable for controlling the return of secondary particles towards the ionization support, said secondary particles being generated by electron bombardment of the focusing electrode, wherein the ions are positive and the additional electrode is biased to stop secondary particles on the active surface of the ionization support through the outlet orifice of the cap to provide heat for the ion source.

13. An ion source according to claim 11 or 12, wherein the focusing electrode is made of tantalum.

* * * * *

UNITED STATES PATENT AND TRADEMARK OFFICE

CERTIFICATE OF CORRECTION

PATENT NO. : 4,801,849

DATED : 1/31/89

INVENTOR(S) : GEORGES SLODZIAN et al.

It is certified that error appears in the above-identified patent and that said Letters Patent is hereby corrected as shown below:

On the Title Page,
Item [73] Assignees: delete "Office National D Etudes et de Recherches, Chatillon; Aerospatiales and Universite de Paris-Sud, Orsay, both of France"

and insert --Office National d'Etudes et de Recherches Aerospatiales, Chatillon; and Universite de Paris-Sud, Orsay, both of France--.

Signed and Sealed this

Twenty-fifth Day of July, 1989

*Attest:*

*Attesting Officer*

DONALD J. QUIGG

*Commissioner of Patents and Trademarks*